US009986774B2

(12) United States Patent
Puente et al.

(10) Patent No.: US 9,986,774 B2
(45) Date of Patent: Jun. 5, 2018

(54) GARMENT CONVERTIBLE INTO A PILLOW

(71) Applicants: Francisco Puente, White Plains, NY (US); Zachary Gow, Nanticoke, PA (US)

(72) Inventors: Francisco Puente, White Plains, NY (US); Zachary Gow, Nanticoke, PA (US)

( * ) Notice: Subject to any disclaimer, the term of this patent is extended or adjusted under 35 U.S.C. 154(b) by 142 days.

(21) Appl. No.: 14/845,502

(22) Filed: Sep. 4, 2015

(65) Prior Publication Data

US 2016/0066632 A1 Mar. 10, 2016

Related U.S. Application Data

(60) Provisional application No. 62/046,371, filed on Sep. 5, 2014.

(51) Int. Cl.

| | |
|---|---|
| ***A41D 15/00*** | (2006.01) |
| ***A41D 15/04*** | (2006.01) |
| ***A41D 1/04*** | (2006.01) |
| ***A47G 9/10*** | (2006.01) |
| *A41D 27/02* | (2006.01) |

(52) U.S. Cl.

CPC ..... *A41D 15/04* (2013.01); *A41D 1/04* (2013.01); *A47G 9/1045* (2013.01); *A41D 27/02* (2013.01)

(58) Field of Classification Search

CPC ..... A41D 15/04; A41D 1/04; A41D 27/02; A47G 9/1045

See application file for complete search history.

(56) References Cited

U.S. PATENT DOCUMENTS

| | | | | |
|---|---|---|---|---|
| 4,404,687 | A * | 9/1983 | Hager | A41D 3/005 2/94 |
| 4,476,587 | A * | 10/1984 | Itoi | A41D 3/005 2/94 |
| 4,502,154 | A | 3/1985 | Itoi | |
| 4,700,409 | A * | 10/1987 | De Lott | A45F 4/12 2/102 |
| 5,010,592 | A | 4/1991 | Skiles, Jr. | |
| 5,564,125 | A * | 10/1996 | Waldman | A41D 3/00 2/93 |
| 5,850,634 | A * | 12/1998 | Toombs | A45F 4/02 2/93 |
| 6,405,377 | B1 * | 6/2002 | Davis | A41D 15/04 2/108 |
| 7,891,032 | B1 | 2/2011 | Ryan | |
| 2006/0000004 | A1 * | 1/2006 | Elen | A41D 3/00 2/108 |
| 2009/0055991 | A1 | 3/2009 | Johnson et al. | |
| 2011/0088135 | A1 | 4/2011 | Snyder et al. | |

FOREIGN PATENT DOCUMENTS

| | | |
|---|---|---|
| WO | WO 1984/01092 | 3/1984 |
| WO | WO 2008/043272 | 4/2008 |

* cited by examiner

*Primary Examiner* — Khaled Annis

(74) *Attorney, Agent, or Firm* — Joseph E. Maenner; Maenner & Associates, LLC

(57) ABSTRACT

In described embodiments, the present invention is a garment having panels provided in an interior portion thereof such that the panels are invertible in the garment insertable into the panels, forming a pillow.

8 Claims, 18 Drawing Sheets

GARMENT CONVERTIBLE INTO A PILLOW

CROSS-REFERENCE TO RELATED APPLICATION

The present application claims priority from U.S. Provisional Patent Application Ser. No. 62/046,371, filed on Sep. 5, 2014, which is incorporated by reference herein in its entirety.

BACKGROUND OF THE INVENTION

Field of the Invention

The present invention relates to an article of clothing, such as a jacket a sweatshirt, or other garment, that is convertible into a pillow.

Description of the Related Art

It is often convenient to be able to have a pillow available, such as when one is traveling, in order to rest one's head. Such example can be while one is traveling in a plane, train, or automobile and one wishes to rest or take a nap. However, it is often not convenient for person to lug a pillow around with them. There exists a need for a garment that a user can wear in the course of normal everyday activities such that the garment is convertible into a pillow for such use when desired.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a garment having panels provided in an interior portion thereof such that the panels are invertible in the garment insertable into the panels, forming a pillow.

In another embodiment, the present invention is a method of converting the garment into a pillow.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Figure 1:
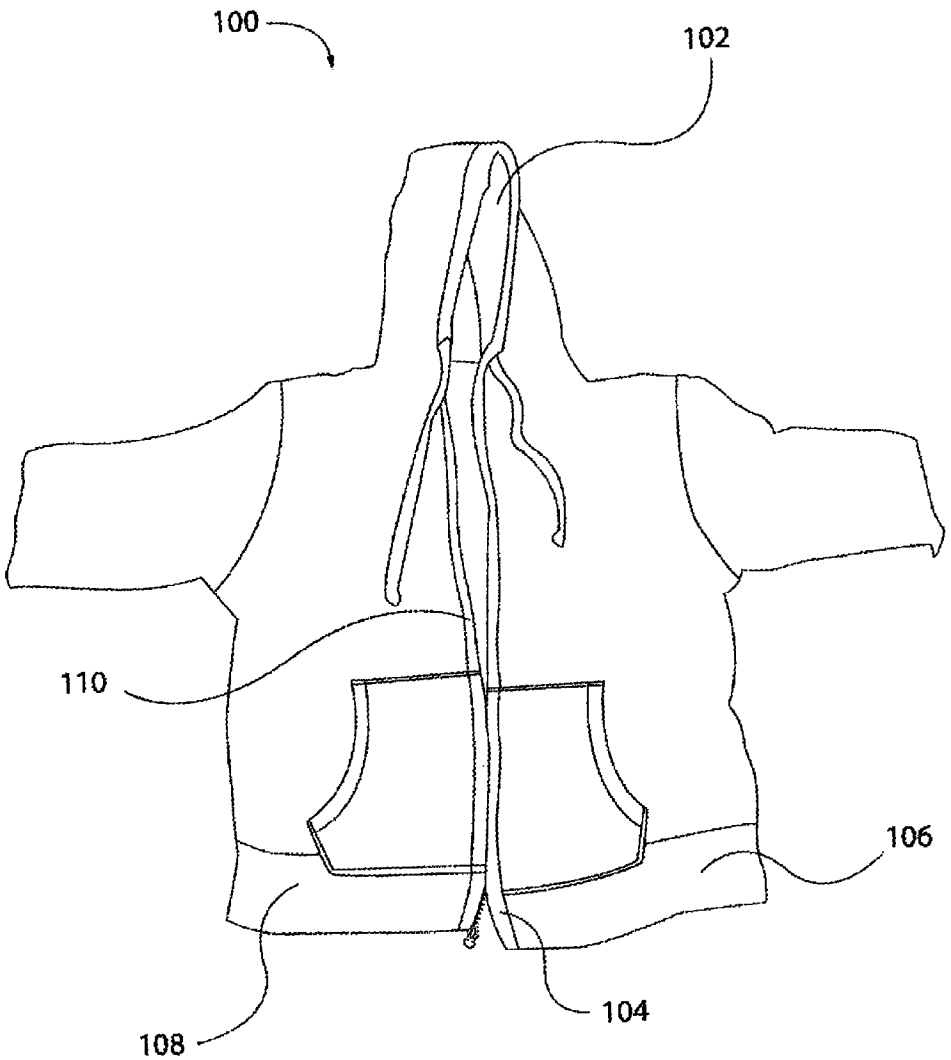
FIG. 1 is a front view of a hooded sweatshirt that is convertible into a pillow according to a first exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

As used herein in reference to an element and a standard, the term "compatible" means that the element communicates with other elements in a manner wholly or partially specified by the standard, and would be recognized by other elements as sufficiently capable of communicating with the other elements in the manner specified by the standard. The compatible element does not need to operate internally in a manner specified by the standard.

Referring to FIGS. 1-8, a convertible garment 100 according to an exemplary embodiment of the present invention is shown. Garment 100 includes an article of clothing, such as, for example, a hooded sweatshirt, also known as a "hoodie" 102 that has an outer material 103 having an open front 104 with two front panels 106, 108 secured to each other by a zipper 110. The zipper 110 connects the two front panels 106, 108 at a waist portion 111 of garment 100, which, when garment 100 is worn by a user, extends generally around the user's waist.

Figure 2:
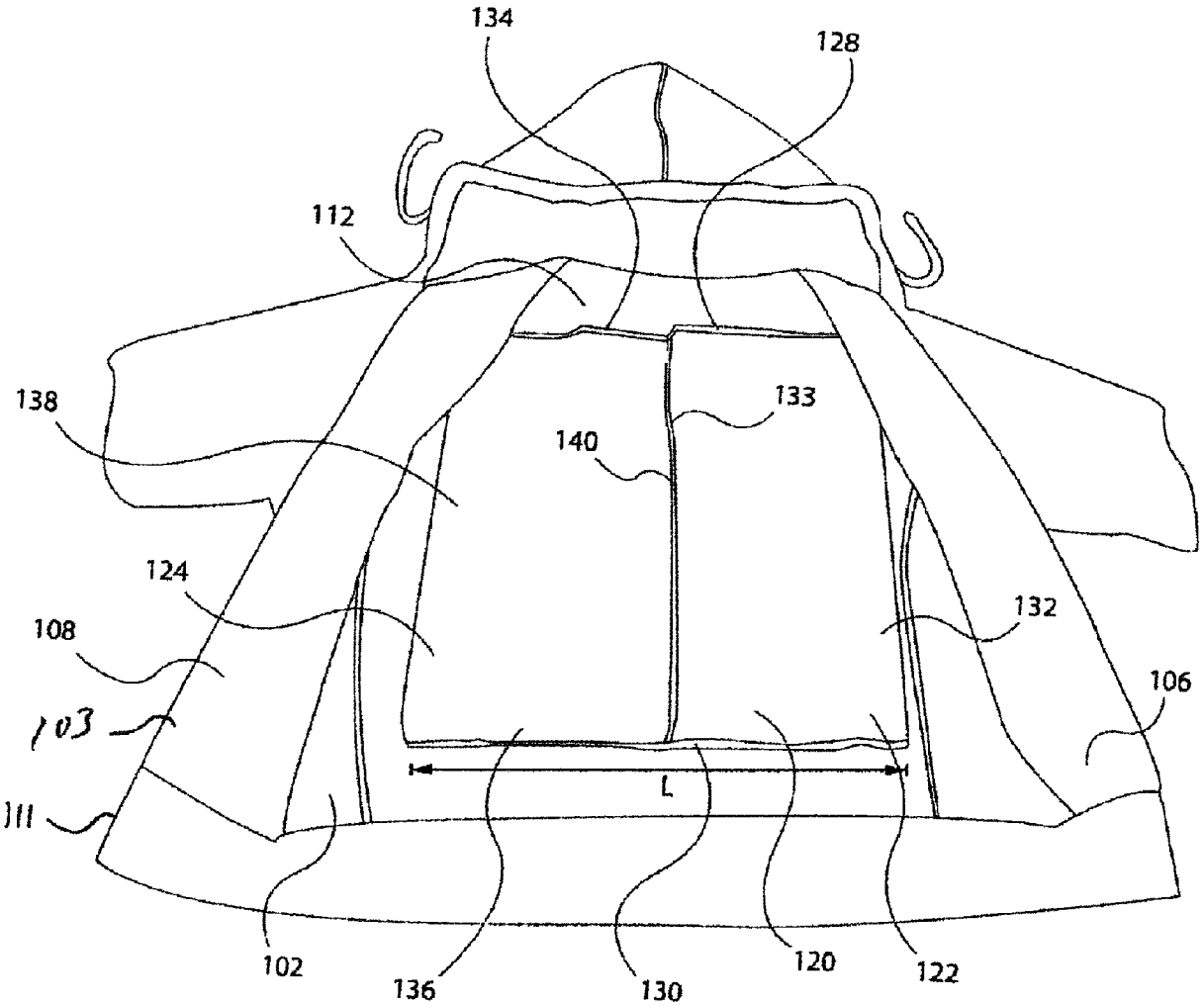
FIG. 2 is a front view of the hooded sweatshirt shown in FIG. 1, having been opened to show an interior rear panel.

FIG. 2 shows hoodie 102 and with panels 106, 108 separated from each other to show a pillow covering 120 attached to an interior rear portion 112 of hoodie 102. Pillow covering 120 may be constructed from a woven fabric material, such as, for example, cotton. Alternatively, pillow covering 120 may be constructed from other material, as will be recognized by those skilled in the art. Pillow covering 120 is generally rectangular in shape and has a length "L" that extends across a rear portion of hoodie 102. While pillow covering 120 is shown as being generally rectangular in shape, those skilled in the art will recognize that pillow covering 120 can be other shapes as well, including, circular, triangular, octagonal, and other shapes. Additionally, pillow covering 120 can include ornamentation for when garment 100 is in the shape of a pillow. By way of example only, animal faces can be printed on pillow covering 120 so that, when garment 100 is formed into the pillow, the animal face is visible.

Pillow covering 120 has a first pocket panel portion 122 and a second, adjacent pocket panel portion 124 that have with such that the sum of the width of first pocket panel portion 122 and second pocket panel portion 124 add up to the same or at least slightly larger than the length "L", resulting in at least a vertical length of second pocket panel portion 124 overlaps first pocket panel portion 122. While first pocket panel portion 122 and second pocket panel portion 124 are shown in FIG. 2 as being horizontally adjacent to each other, those skilled in the art will recognize that first pocket panel portion 122 can be located vertically above second pocket panel portion 124.

First pocket panel portion 122 is fixedly attached to interior rear portion 112 of hoodie 102 along three sides, namely a first generally horizontal top side 128, a first generally horizontal bottom side 130, and a first generally vertical side 132, which connects first top side 128 and first bottom side 130. First vertical side 132 is located away from second pocket panel portion 124. An open vertical side 133, extending between first horizontal top side 128 and first horizontal bottom side 130, proximate to second pocket panel portion 124, is unattached, forming a first pocket portion 123 (shown in FIG. 3). Open vertical side 133 extends generally perpendicular to waist portion 111.

Similarly, second pocket panel portion 124 is fixedly attached to interior rear portion 112 of hoodie 102 along three sides, namely a second generally horizontal top side 134, a second generally horizontal bottom side 136, and a second generally vertical side 138, which connects second top side 134 and second bottom side 136. Second vertical side 138 is located away from first pocket panel portion 122. An open vertical side 139, extending between second horizontal top side 134 and second horizontal bottom side 136, proximate to first pocket panel portion 122, is unattached, forming a second pocket portion 127 (shown in FIG. 3).

Figure 3:
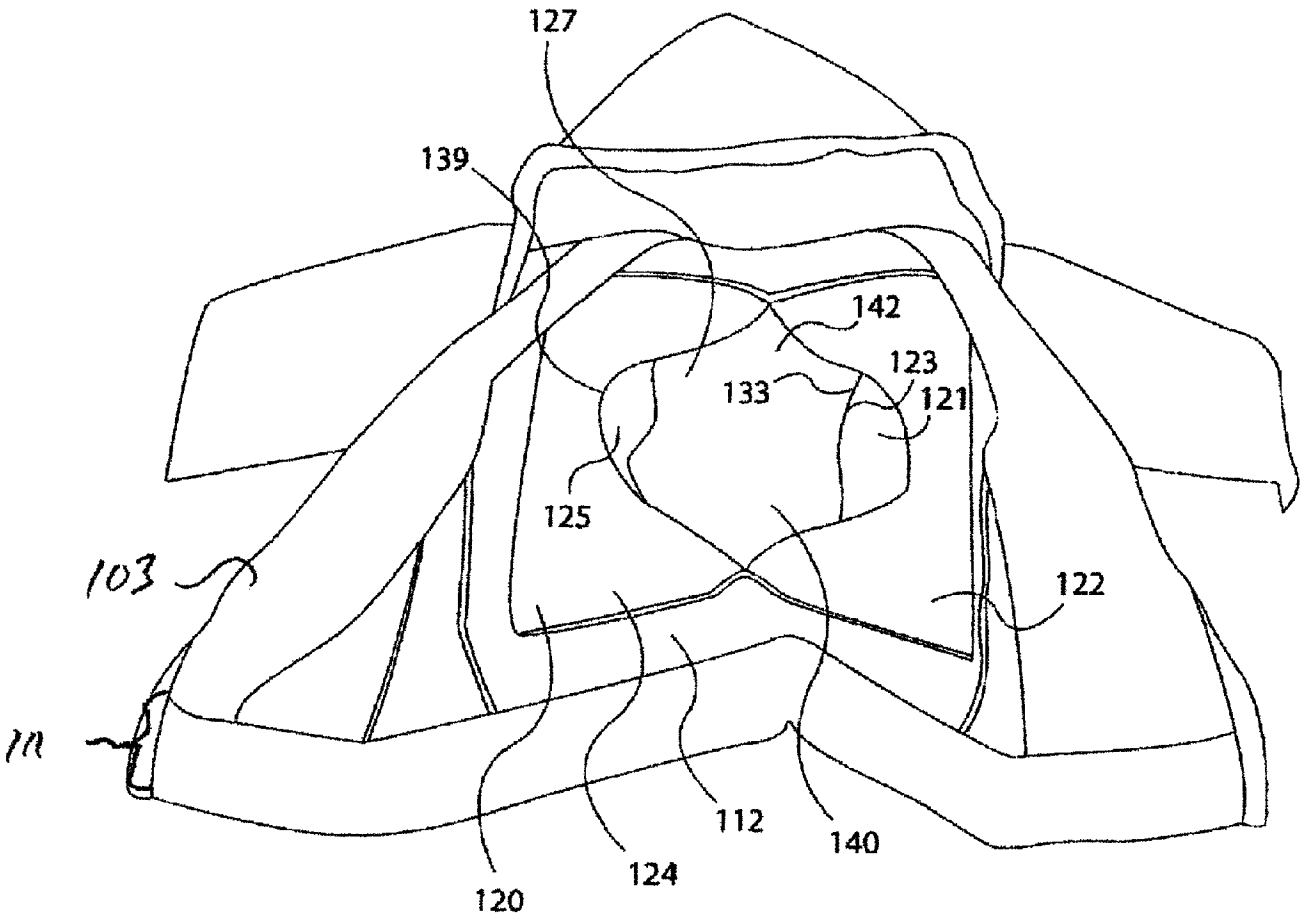
FIG. 3 is a front view of the hooded sweatshirt shown in FIG. 2, with pillow panels in the interior rear panel being opened.

FIG. 3 shows open vertical sides 133, 138 being separated from each other to show a rear surface 140 of pillow portion 120. Rear surface 140 is fixedly attached along all of its edges to interior rear portion 112 of hoodie 102. As shown FIG. 3, an exemplary fabric pattern 142 of rear surface 140 is in facing engagement with an exemplary fabric pattern 121 on first pocket panel portion 122 and an exemplary fabric pattern 125 on second pocket panel portion 124. In an exemplary embodiment, exemplary fabric patterns 142, 121, and 125 are the same pattern, although those skilled in the art will recognize that fabric patterns 142, 121, and 125 can be different patterns. For example, fabric patterns 121, 125 may be the same, while fabric pattern 142 is different from fabric patterns 121, 125. While fabric patterns 121, 125, 142 shown in FIGS. 2-8 show stars and stripes, other fabric patterns and/or designs, such as, for example, team logos, can be used.

Pillow covering 120 can be releasably attached to hoodie 102, such as, for example, by hook and loop fastener, or other suitable releasable adhesive method. Alternatively, pillow covering 120 can be fixedly attached to hoodie 102, such as, for example, by ironing or other suitable fixed adhesive method.

Figure 4:
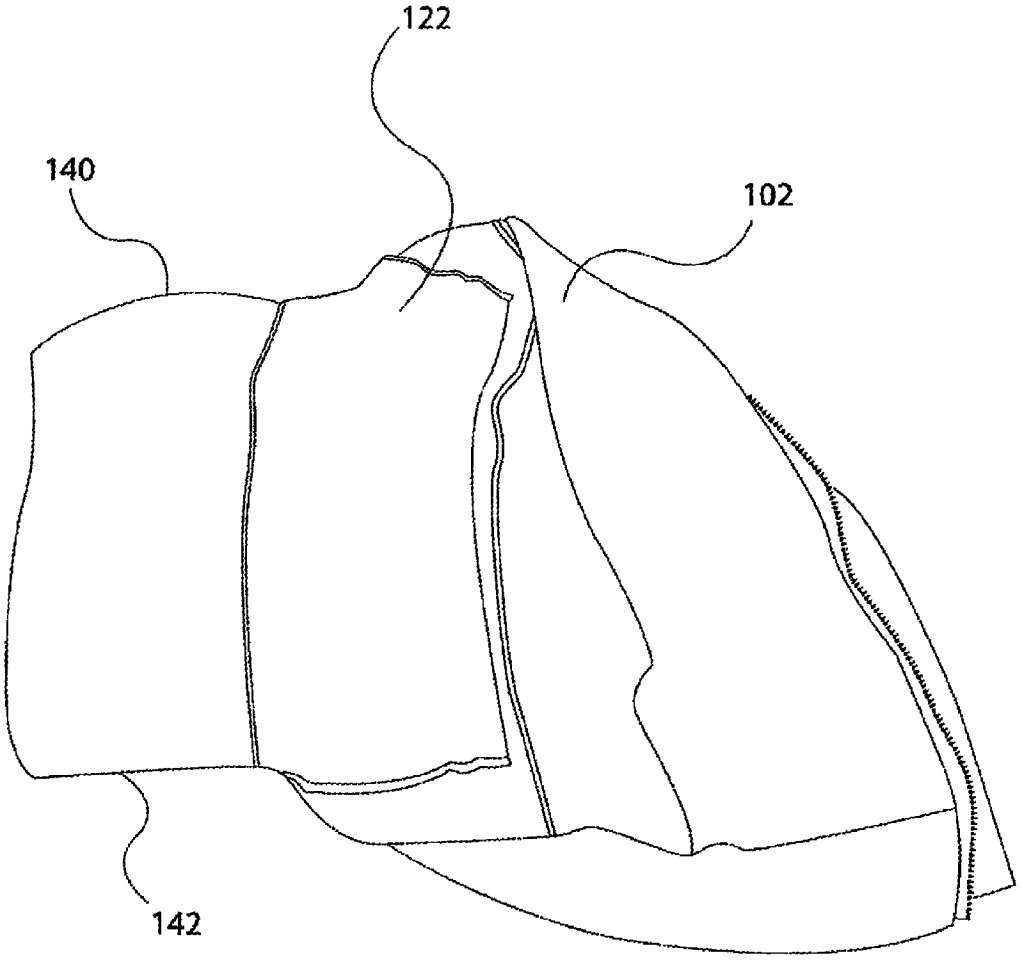
FIG. 4 is a perspective view of the hooded sweatshirt shown in FIGS. 1-3, with one of the pillow panels being inverted and a portion of the sweatshirt being stuffed into the inverted pillow panel.
Figure 5:
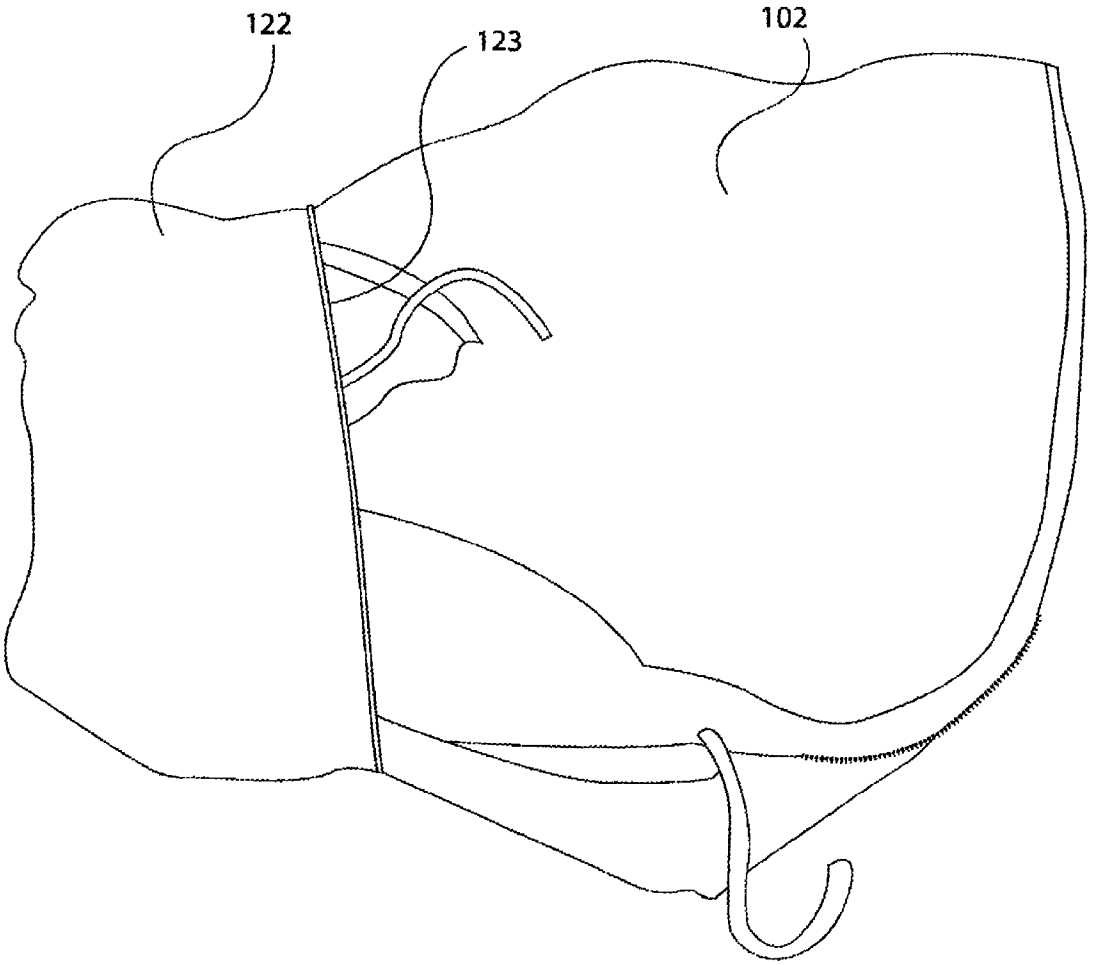
FIG. 5 is a perspective view of the hooded sweatshirt shown in FIG. 4, with more of the sweatshirt being stuffed into the inverted pillow panel.
Figure 6:
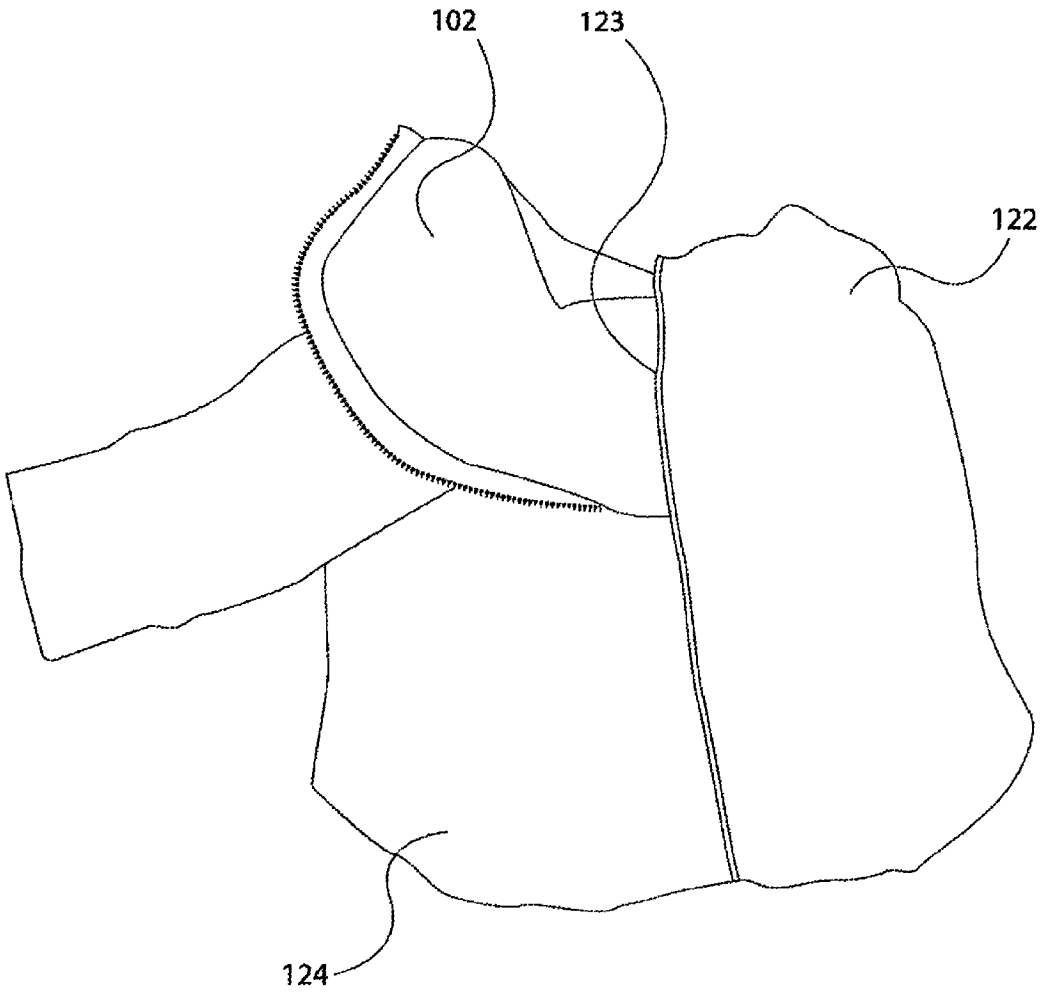
FIG. 6 is a perspective view of the hooded sweatshirt shown FIG. 5, with a second pillow panel being inverted and more of the sweatshirt being stuffed into the second inverted pillow panel.
Figure 7:
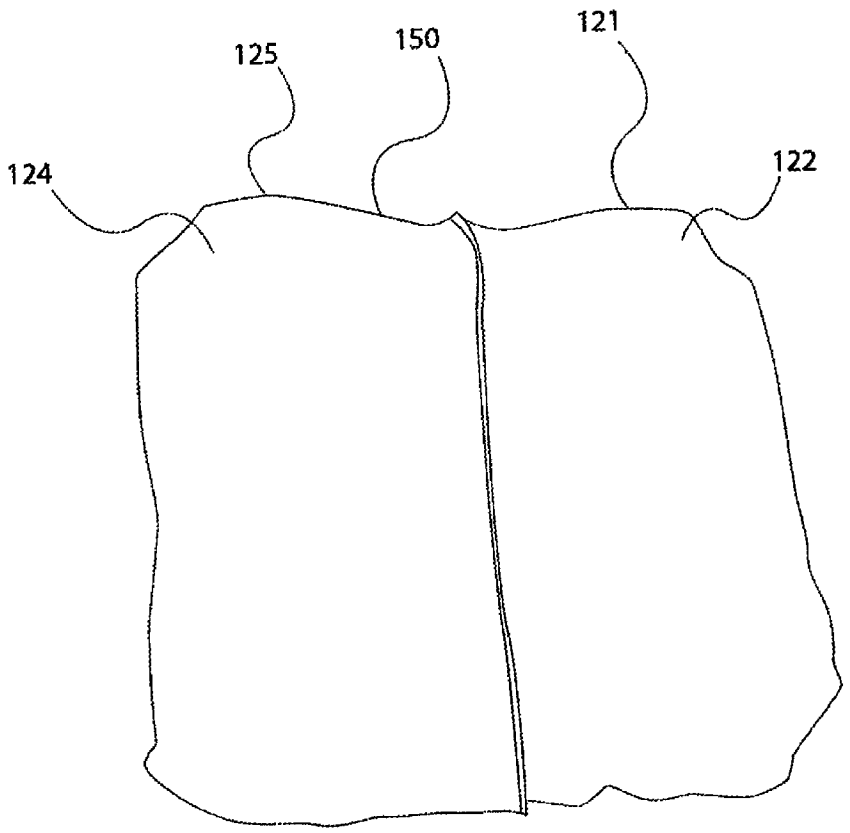
FIG. 7 is a front view of the sweatshirt being fully stuffed into the pillow panels, forming a pillow.
Figure 8:
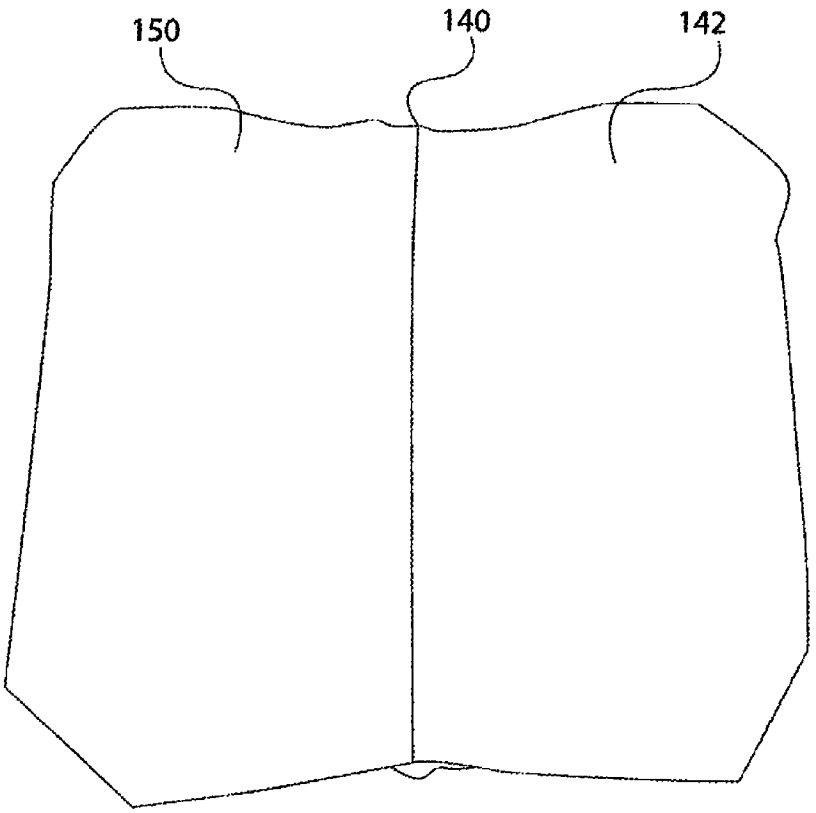
FIG. 8 is a rear view of the pillow shown in FIG. 7

FIGS. 4-6 show the process of converting hoodie 102 into a pillow 150, with the completed pillow 150 being shown in FIGS. 7 and 8. Open vertical sides 133, 139 are pulled apart from each other and rear surface 140 is pushed between the space formed between open vertical sides 133, 139 such that first pocket panel portion 122 and second pocket panel portion 124 become inverted, exposing fabric patterns 121, 125. FIG. 4 shows second pocket panel portion 124 in an inverted state, exposing a portion of rear surface 140 and its fabric pattern 142. A portion of hoodie 102 has been stuffed into second pocket portion 127.

First pocket panel portion 122 is still in its original state, with a remaining portion of hoodie 102, remaining outside of first pocket portion 123. FIGS. 5 and 6 show first pocket panel portion 122 having been inverted, with hoodie 102 being progressively stuffed into first pocket portion 123. FIG. 7 shows garment 100 fully converted into pillow 150, with hoodie 102 stuffed into first pocket portion 123 and second pocket portion 127. Because the sum of the width of first pocket panel portion 122 and second pocket panel portion 124 add up to the same or at least slightly larger than the length "L", hoodie 102 is fully contained within pillow 150, with a portion of second pocket panel portion 124 overlapping first pocket panel portion 122. FIG. 8 shows a reverse side of pillow 150, with a rear surface 140, forming the shape of pillow 150.

Figure 9:
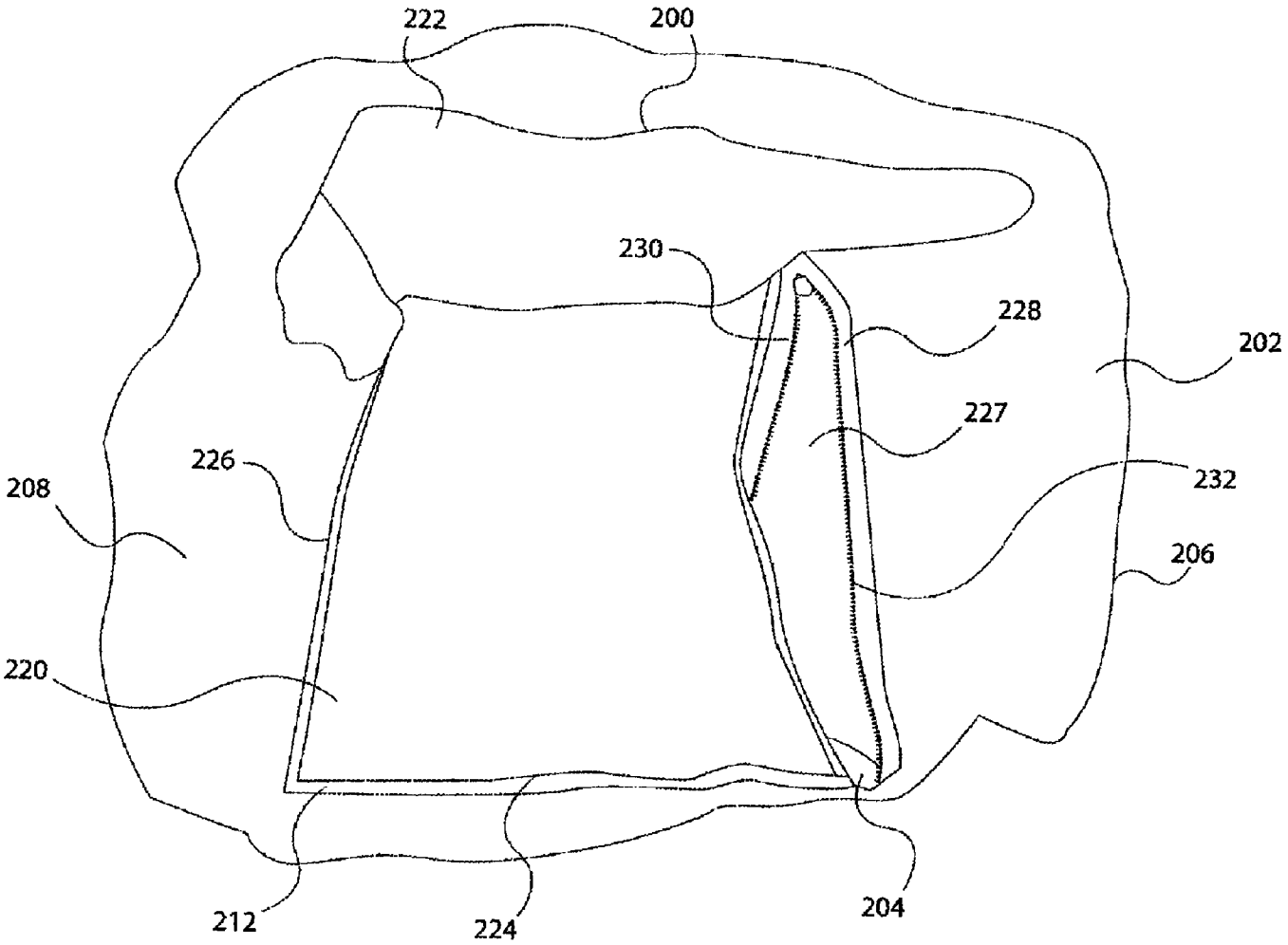
FIG. 9 is a front view of a hooded sweatshirt that is convertible into a pillow according to a second exemplary embodiment of the present invention.
Figure 11:
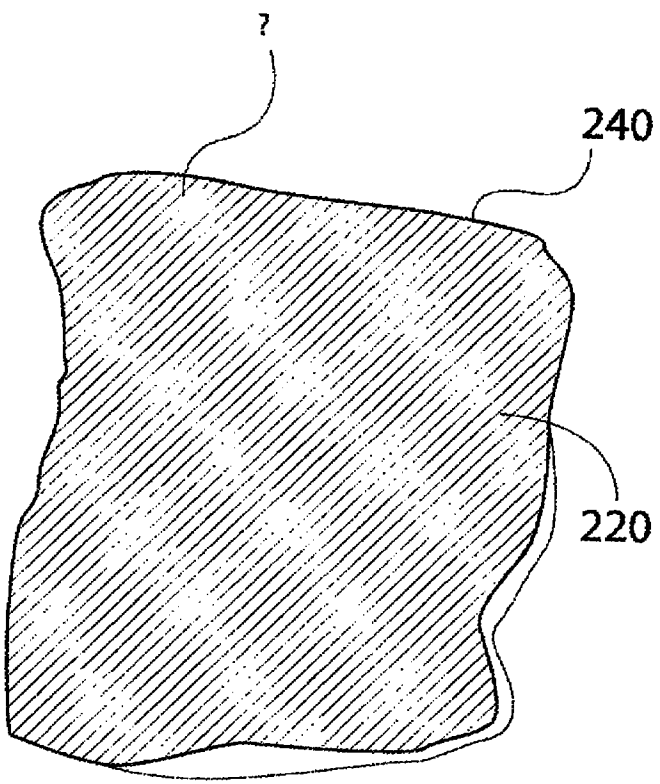
FIG. 11 is a rear view of the pillow shown in FIG. 10.
Figure 10:
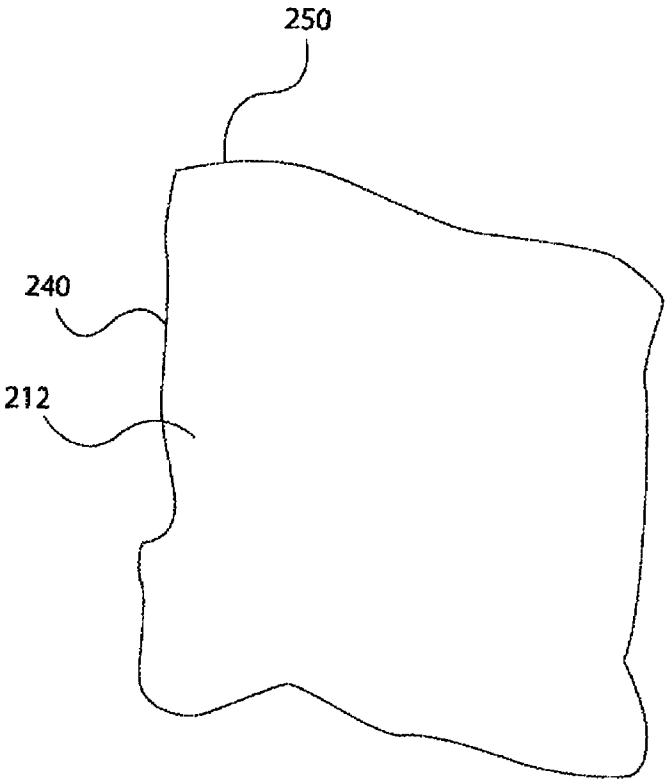
FIG. 10 is a front view of the sweatshirt shown in FIG. 9, having been converted into a pillow.

FIGS. 9-11 show a convertible garment 200 according to an alternative embodiment of the present invention. Referring to FIG. 9, similar to garment 100, garment 200 includes an article of clothing, such as, for example, a hoodie 202 that has an open front 204 with two front panels 206, 208. Although not shown, front panels 206, 208 can include a zipper.

A pillow covering 220 is attached to an interior rear portion 212 of hoodie 202. A top edge 222, a bottom edge 224, and a side edge 226 that extends between top edge 222 and bottom edge 224 are fixedly attached to interior rear portion 212 of hoodie 202, forming a pouch 227. An open edge 228 that extends between top edge 222 and bottom edge 224, away from side edge 226 has a first zipper half 230 attached thereto. A corresponding second zipper half 232 is fixedly attached to interior rear portion 212 of hoodie 202. While zipper half 230 is shown with edge 228, those skilled in the art will recognize that zipper half 230 can be used with any of edges 222, 224, 226, and 228, as long as that edge is an open edge. Further, while interior rear portion 212 is used, those skilled in the art will recognize that an additional piece of fabric (not shown) can be attached over interior rear portion 212. Additionally, while zipper halves 230, 232 are shown, those skilled in the art will recognize that other closure means, such as, for example, hook and loop fasteners, snaps, magnets, and the like can be used instead.

When garment 200 is used as hoodie 202, first zipper half 230 can be Either zipped or unzipped to second zipper half 232, as desired by the user. Optionally, pouch 227 can be used to store items (not shown) therein, zipping up zipper halves 230, 232, to retain the items within pouch 227.

To convert garment 200 into a pillow 240, side edge 226 is pushed between pillow covering 220 and interior rear portion 212 of hoodie between first zipper half 230 and second zipper half 232, inverting pillow covering 220 and pulling garment 200 along with side edge 226. Garment 200 is folded such that, when pillow covering 220 is fully inverted, garment 200 is fully stuffed within an inverted form of pouch 227, forming the pillow 240 shown FIGS. 10 and 11.

As shown in FIG. 10, one side of pillow 240 is the material of interior rear portion 212 of hoodie 202, while, as shown in FIG. 11, an opposing side of pillow 240 is a reverse side of pillow covering 220. If, however, an additional piece of fabric is attached over interior rear portion 212 as discussed above, the additional piece of fabric will become the one side of pillow 240. As can be seen in FIGS. 10 and 11, both the material and the design of opposing sides of pillow 230 can differ.

Figure 11A:
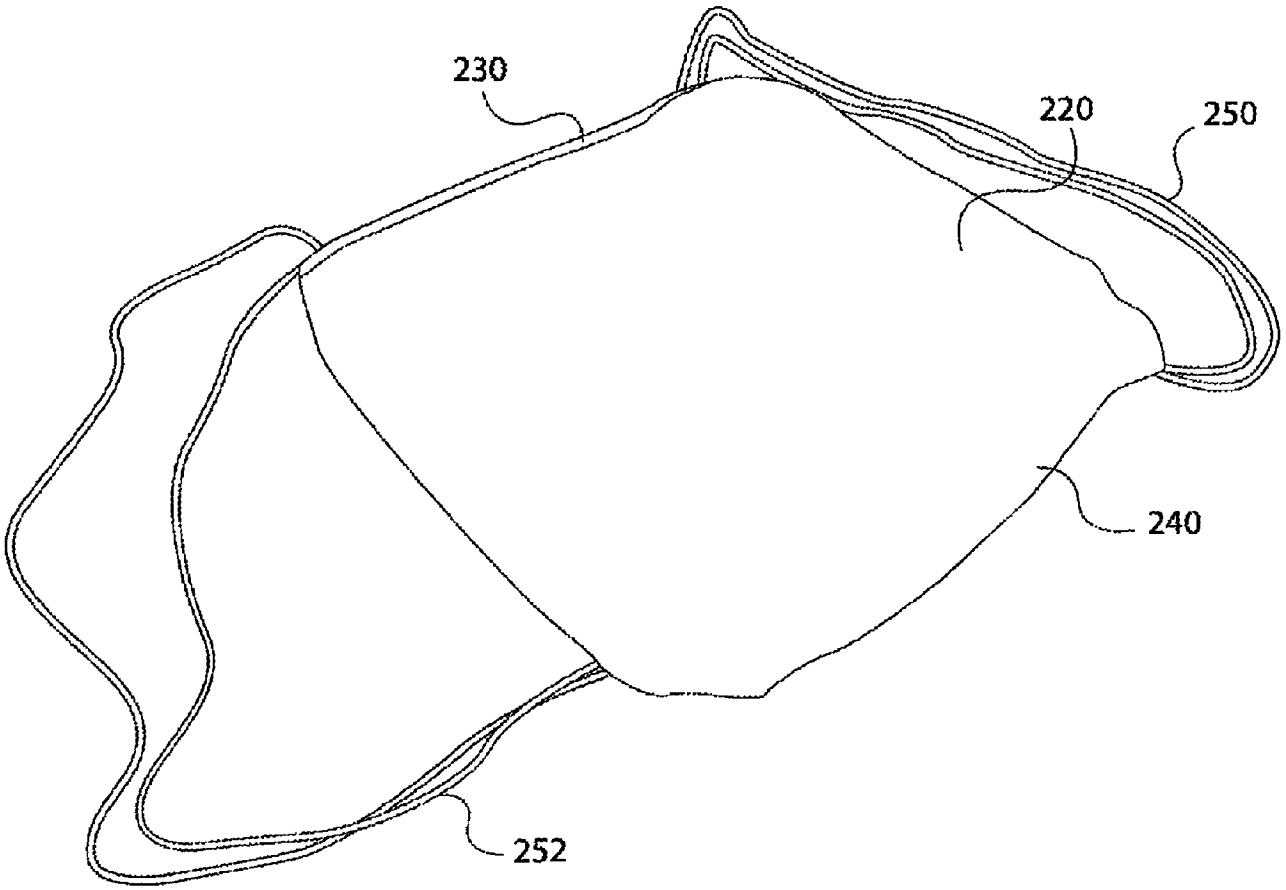
FIG. 11A is a rear view of a pillow constructed according to the pillow shown in FIGS. 10 and 11, with optional drawstrings attached.

Optionally, as shown in FIG. 11A, drawstrings 250, 252 can be attached to an interior of pouch 227 such that, when hoodie 202 is converted into pillow 240, drawstrings are located on either side of zipper halves 230, 232, allowing pillow 240 to be carried similarly to a backpack.

Figure 12:
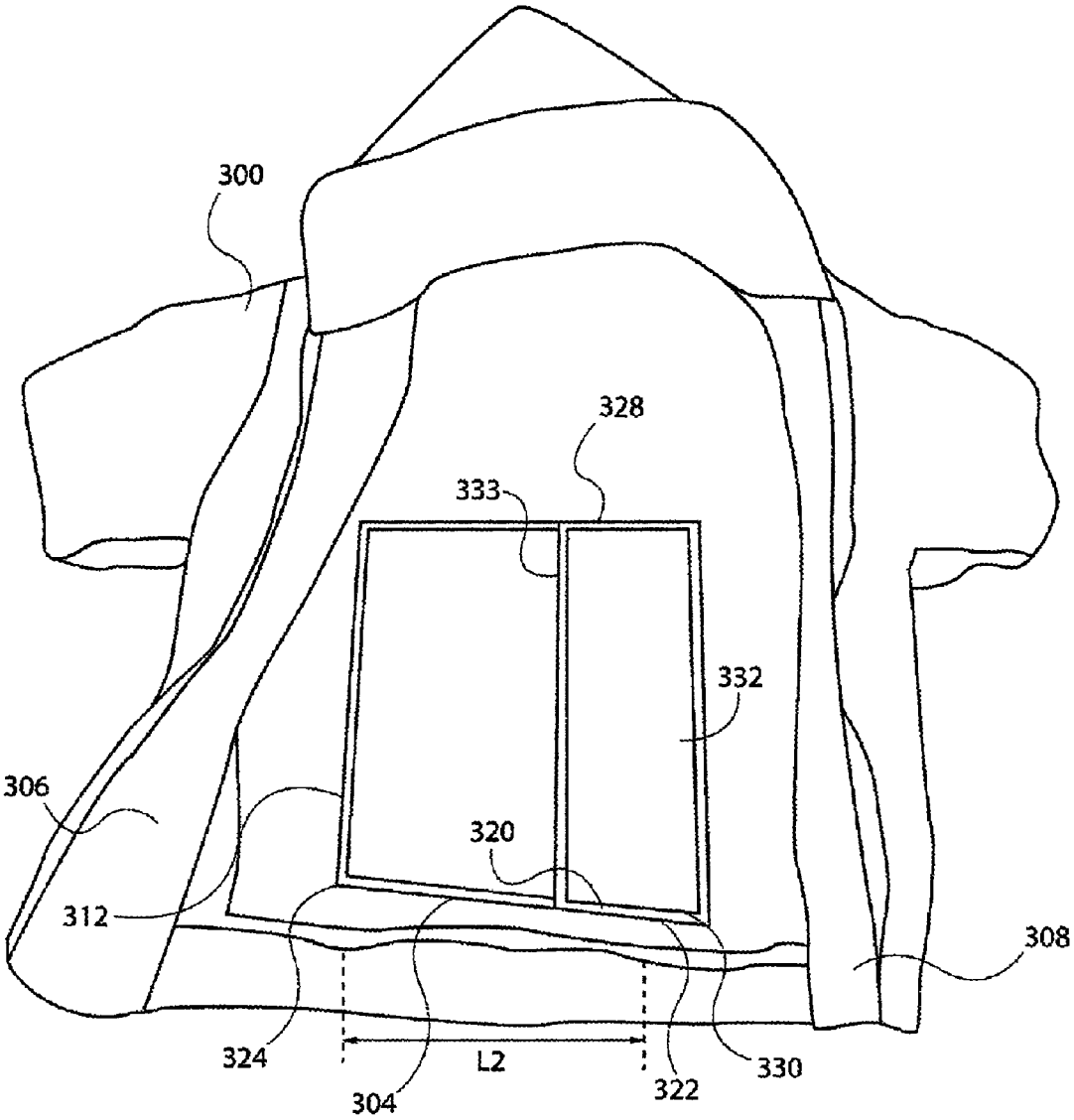
FIG. 12 is a front view of a hooded sweatshirt that is convertible into a pillow according to a third exemplary embodiment of the present invention.
Figure 13:
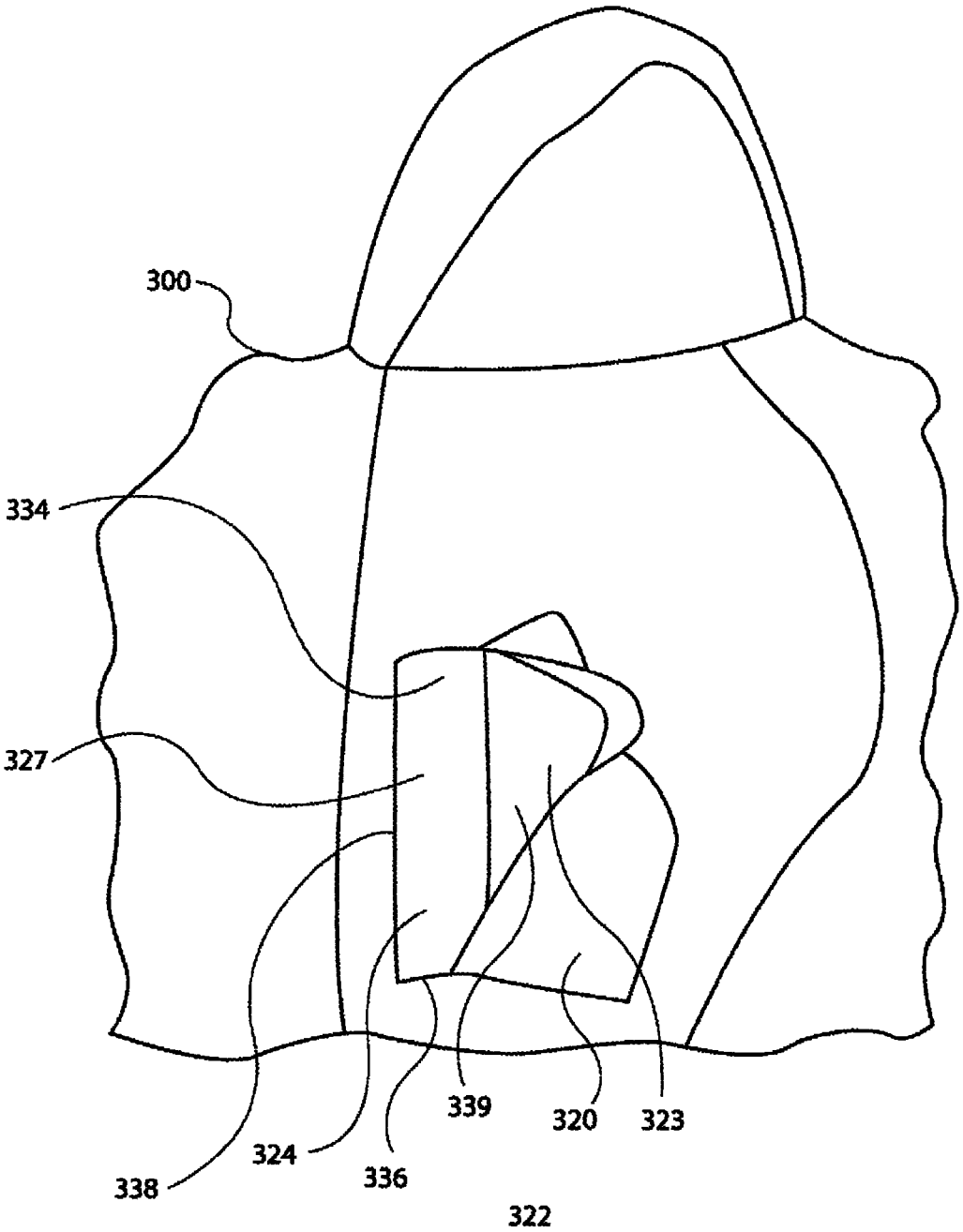
FIG. 13 is a front view of the hooded sweatshirt of FIG. 12 with an interior panel opened to convert the sweatshirt into a pillow.

An alternative embodiment of a garment 300 according to the present invention is shown in FIGS. 12-16. Referring to FIG. 12, similar to garment 100, garment 300 includes an article of clothing, such as, for example, a hoodie 302 that has an open front 304 with two front panels 306, 308 that are separated from each other to show a pillow covering 320 attached to an interior rear portion 312 of hoodie 302. Pillow covering 320 may be constructed from a woven fabric material, such as, for example, cotton. Alternatively, pillow covering 320 may be constructed from other material, as will be recognized by those skilled in the art. Pillow covering 320 is generally rectangular in shape and has a length "L2" that extends across a rear portion of hoodie 302. While pillow covering 320 is shown as being generally rectangular in shape, those skilled in the art will recognize that pillow covering 320 can be other shapes as well, including, circular, triangular, octagonal, and other shapes.

Pillow covering 320 has a first pocket panel portion 322 and a second, adjacent pocket panel portion 324 that have with such that the sum of the width of first pocket panel portion 322 and second pocket panel portion 324 add up to the same or at least slightly larger than the length "L2", resulting in at least a vertical length of first pocket panel portion 322 overlaps second pocket panel portion 324. While first pocket panel portion 322 and second pocket panel portion 324 are shown in FIG. 12 as being horizontally adjacent to each other, those skilled in the art will recognize that first pocket panel portion 322 can be located vertically above second pocket panel portion 324.

First pocket panel portion 322 is fixedly attached to interior rear portion 312 of hoodie 302 along three sides, namely a first generally horizontal top side 328, a first generally horizontal bottom side 330, and a first generally vertical side 332, which connects first top side 328 and first bottom side 330. Optionally, first pocket panel portion 322 may be constructed from interior rear portion 312 of hoodie 302. First vertical side 332 is fixedly connected to interior rear portion 312 and is located away from second pocket panel portion 324. An open vertical side 333, extending between first horizontal top side 328 and first horizontal bottom side 330, proximate to second pocket panel portion 324, is unattached, forming a first pocket portion 323 (shown in FIGS. 13 and 14).

Unlike second pocket panel portion 124 in garment 100, second pocket panel portion 324 is formed from interior rear portion 312 of hoodie 302. Second pocket panel portion 324 is contiguous with interior rear portion 312 of hoodie 302 along three sides, namely a second generally horizontal top side 334, a second generally horizontal bottom side 336, and a second generally vertical side 338, which connects second top side 334 and second bottom side 336. Second vertical side 338 is located away from first pocket panel portion 322. An open vertical side 339, extending between second horizontal top side 334 and second horizontal bottom side 336, proximate to first pocket panel portion 322, is formed by cutting through interior rear portion 312, forming a second pocket portion 327 (shown in FIGS. 13 and 14).

While one side of the cut of interior rear portion 312 forms second pocket portion 327, an opposing side of the cut through interior rear portion 312 is fixedly connected to first vertical side 332 of first pocket panel portion 322, as discussed above.

Figure 14:
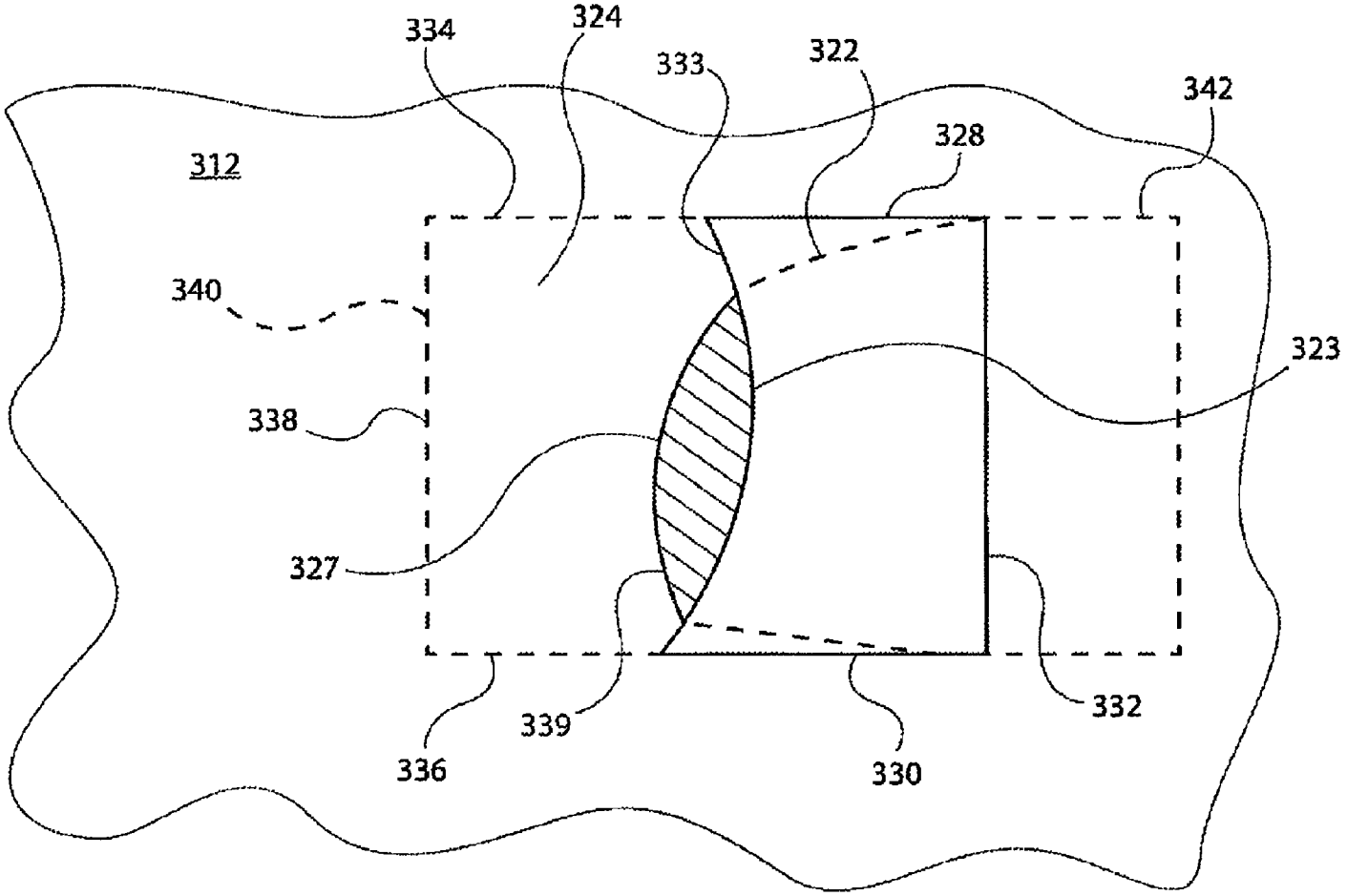
FIG. 14 is a partial front view of the hooded sweatshirt of FIG. 12, showing an interior panel thereof.

A pillow exterior side 340, shown in broken lines in FIG. 14, is fixedly attached to a reverse side of interior rear portion 312. A portion 342 of pillow exterior side 340 extends beyond first pocket panel portion 322. When garment 300 is in the configuration of hoodie 302, as shown in FIG. 14, pillow exterior side 340 is only visible when first pocket panel portion 322 and second pocket panel portion 324 are pulled apart from each other, as shown. The diagonal lines in FIG. 14 represent the visible portion of pillow exterior side 340.

Figure 15:
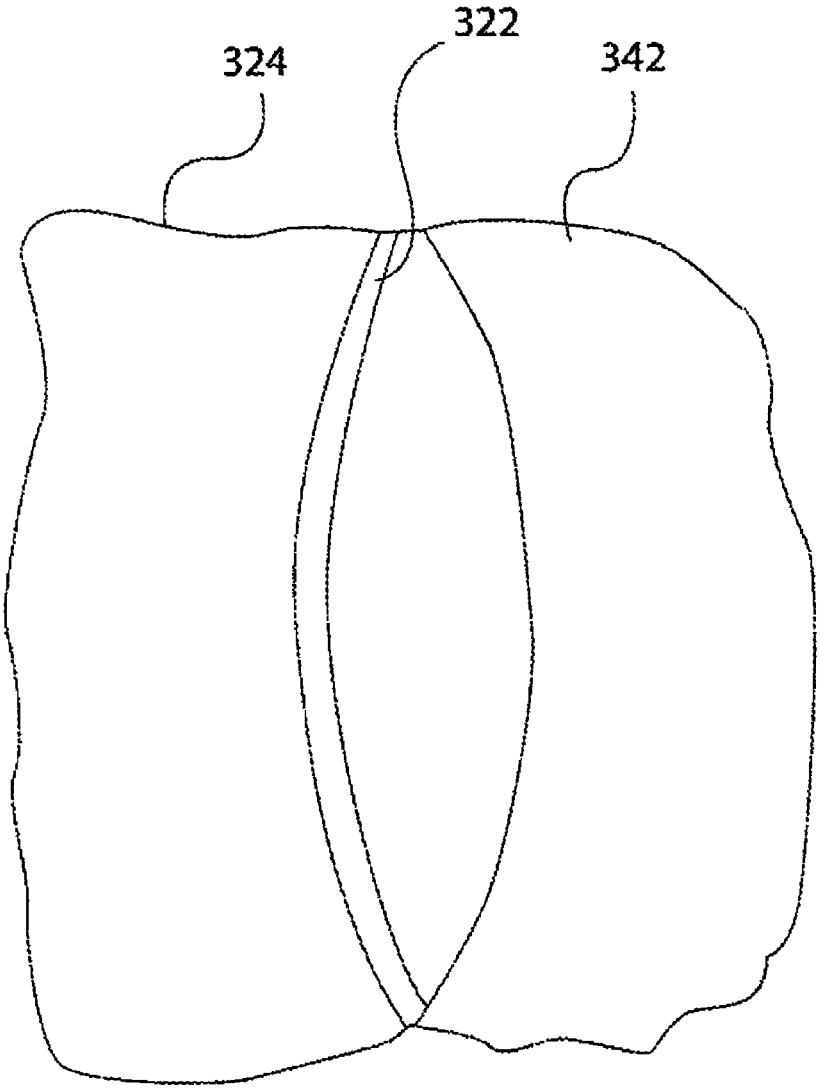
FIG. 15 is a front view of the sweatshirt shown in FIG. 12, having been converted into a pillow.
Figure 16:
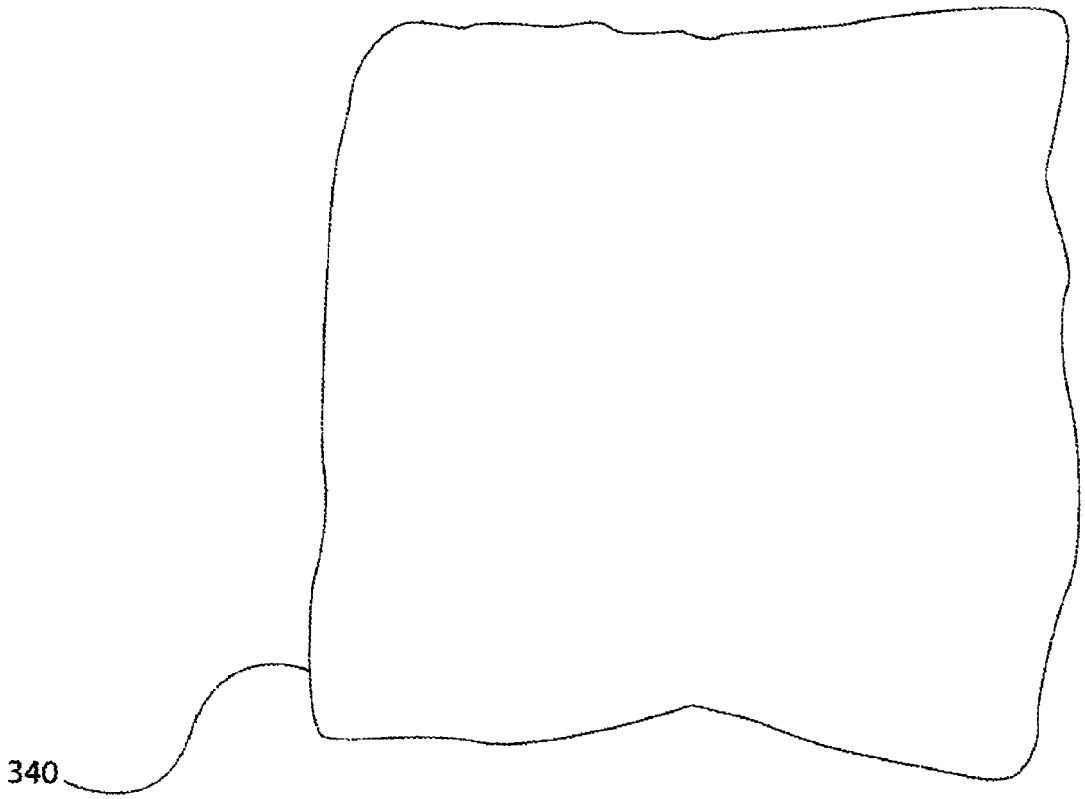
FIG. 16 is a rear view of the pillow shown in FIG. 14.

To form a pillow from garment 300, first pocket panel portion 322 and second pocket panel portion 324 are inverted, with hoodie 302 stuffed into first pocket portion 323 and second pocket portion 327. As shown in FIG. 15, a reverse side of first pocket panel portion 322 and second pocket panel portion 324 are visible, along with part of interior rear portion 312 that is aligned with portion 342 of pillow exterior side 340.

Figure 17:
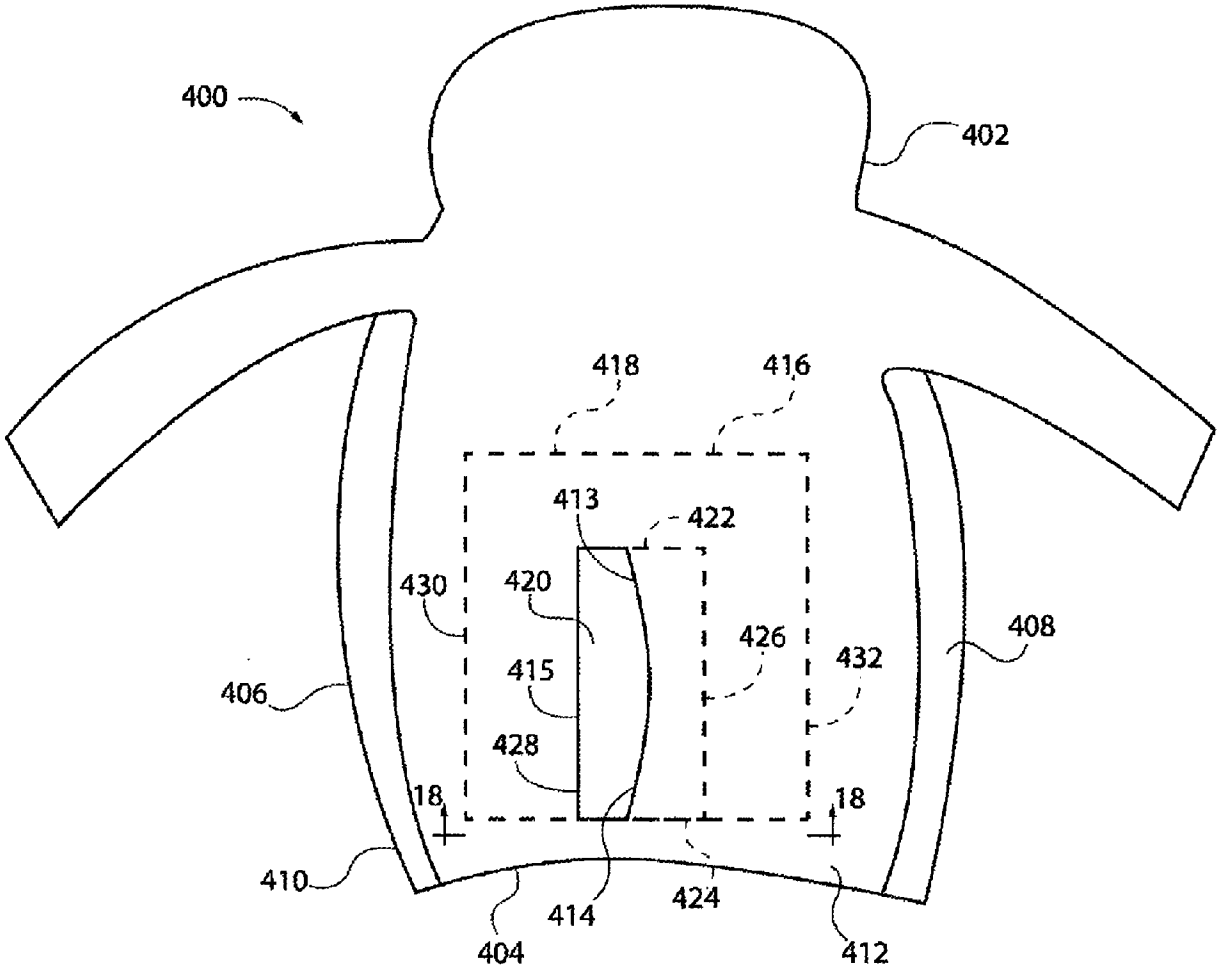
FIG. 17 is a front view of a hooded sweatshirt that is convertible into a pillow according to a fourth exemplary embodiment of the present invention.
Figure 18:
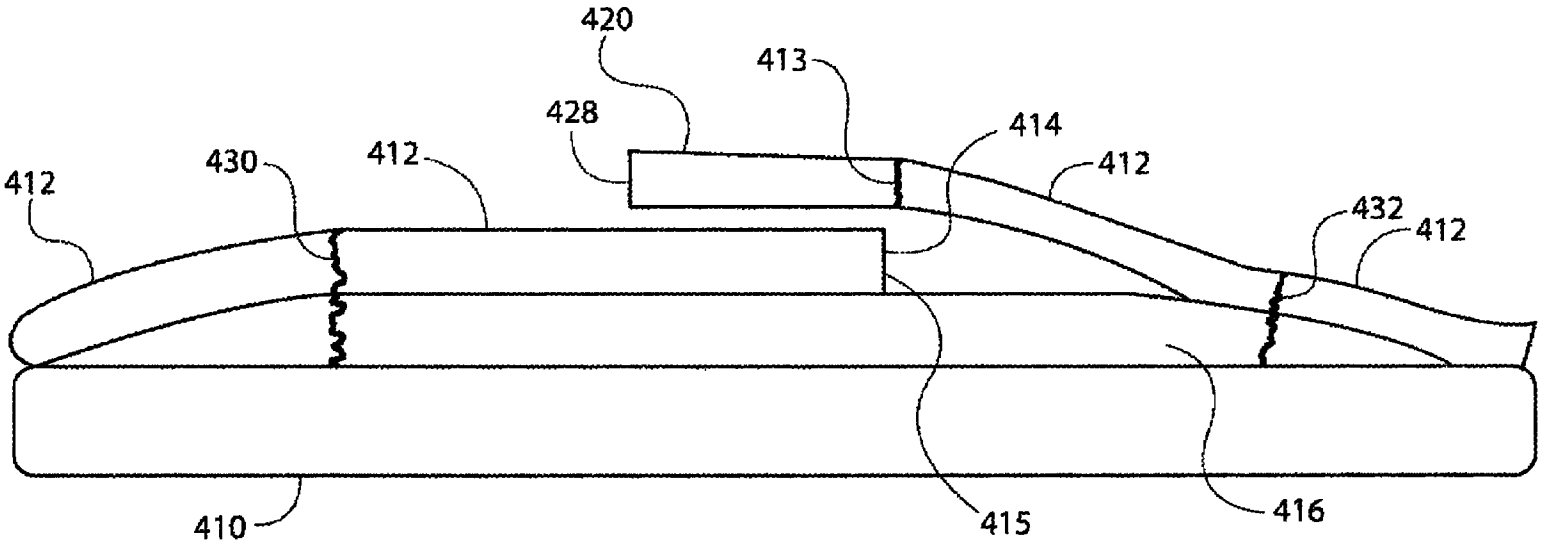
FIG. 18 is a sectional view of the hoodie of FIG. 17, taken along lines 18-18 of FIG. 17.

Still another alternative embodiment of a garment 400 according to the present invention is shown in FIGS. 17 and 18. Referring to FIG. 17, similar to garment 100, garment 400 includes an article of clothing, such as, for example, a hoodie 402 that has an open front 404 with two front panels 406, 408. Although not shown, front panels 406, 408 can include a zipper.

Garment 400 includes an outer material 410 and an inner lining 412 sewn to outer material 410 along edges, such that a gap is present between outer material 410 and inner lining 412.

A vertical slit 414 is cut in inner lining 412, forming a first vertical edge 413 and a second vertical edge 415. An interior liner 416 is sewn to inner lining 412 between inner lining 412 and outer material 410 as shown by the rectangle 418 defined by the dashed lines in FIG. 17. A pillow panel 420 is sewn to both interior liner 416 and inner lining 412 at a horizontal top seam 422 and a horizontal bottom seam 424 and to second vertical edge 415 of inner lining 412 along a vertical seam 426. A first vertical edge 428 of pillow panel 420 is unsewn. Inner lining 412 is sewn to interior liner 416 along vertical seams 430, 432.

To form garment 400 into a pillow, first vertical edge 413 is pulled to the left as shown in FIG. 17 and vertical edge 428 is pulled to the right, exposing at least a portion of interior liner 416. Garment 400 is pushed through the gap formed between first vertical edge 413 and first vertical edge 428 and pillow panel 420 and inner lining 412 are inverted until a reverse side 430 of pillow panel 420, a reverse side of inner lining 412 between first vertical edge 413 and interior liner 416, as well as interior liner 416 are exposed, forming a pillow.

In an exemplary embodiment, pillow panel 420, interior liner 416, and a reverse side of inner lining 412 have the same design such that, when garment 400 is inverted into the pillow, all exposed sides of the pillow have the same visible design.

It will be further understood that various changes in the details, materials, and arrangements of the parts which have been described and illustrated in order to explain the nature of this invention may be made by those skilled in the art without departing from the scope of the invention as expressed in the following claims.

We claim:

1. A garment convertible into a pillow, the garment comprising:

an outer material having a waist portion adapted to be positioned adjacent a waist region of a wearer when worn;

an inner lining sewn to the outer material, the inner lining having a slit formed therein generally perpendicular to the waist portion, the slit forming a first portion having a first vertical edge and a second portion having a second vertical edge such that the first vertical edge (133) overlays the second portion (124); a rear surface (140) located between the inner lining (122/124) and the outer material (103) and attached to the outer material (103);

an interior liner connected to the inner lining between the inner lining and the outer material; and a pillow panel sewn to both the interior liner and the inner lining at a horizontal top seam and a horizontal bottom seam and to the second vertical edge of the inner lining along a vertical seam, such that a vertical edge of the pillow panel extends between the inner lining and interior liner.

2. The garment according to claim 1, wherein, when the first vertical edge is pulled in a first direction and the interior liner is pulled in a second direction, the outer material is able to be pushed between the first vertical edge and the interior liner, forming the pillow.

3. The garment according to claim 1, wherein the inner lining is connected to the interior liner distal from the first vertical edge.

4. The garment according to claim 1, wherein the pillow panel is sewn to the inner lining.

5. The garment according to claim 1, wherein the interior liner is sewn to the inner lining distal from the second vertical edge.

6. A method of forming a pillow from a garment comprising the steps of:

(a) providing the garment according to claim 1;

(b) pulling the pillow panel in a first direction;

(c) pulling the interior lining in a second direction, opposite from the first direction, forming a gap between the pillow panel and the interior lining;

(d) pushing the garment through the gap; and (e) inverting the pillow panel and the interior lining around the garment.

7. The method according to claim 6, wherein steps (d) and (e) are performed simultaneously.

8. A garment convertible into a pillow, the garment comprising:

an outer material having waist portion adapted to be positioned adjacent a waist region of a wearer when worn;

an interior rear portion;

a pillow covering attached to the interior rear portion and has a first length;

a first pocket panel portion fixedly attached to interior rear portion along at least a first generally horizontal top side and a first generally horizontal bottom side and having an open first vertical side extending generally perpendicular to the waist portion;

a second pocket panel portion adjacent to the first pocket panel portion, the first and second pocket panel portions having a combined length at least as long as the first length, such that at least a vertical length of the second pocket panel portion overlaps the first pocket panel portion, wherein the second pocket panel portion is fixedly attached to interior rear portion along at least a second generally horizontal top side and a second generally horizontal bottom side and has an open second vertical side extending generally perpendicular to the waist portion, wherein the first and second open vertical sides are separable from each other to show the interior rear portion.

* * * * *